US008795789B2

(12) United States Patent
Otaki et al.

(10) Patent No.: US 8,795,789 B2
(45) **Date of Patent: *Aug. 5, 2014**

(54) COATING AGENT FOR A WATER PRESSURE TRANSFER FILM, A WATER PRESSURE TRANSFER METHOD AND A WATER PRESSURE TRANSFER ARTICLE

(75) Inventors: Nobuyuki Otaki, Shizuoka (JP); Wataru Ikeda, Shizuoka (JP); Tomomi Kiyotaki, Shizuoka (JP)

(73) Assignee: Taica Corporation, Tokyo (JP)

( * ) Notice: Subject to any disclaimer, the term of this patent is extended or adjusted under 35 U.S.C. 154(b) by 66 days.

This patent is subject to a terminal disclaimer.

(21) Appl. No.: 13/472,155

(22) Filed: May 15, 2012

(65) Prior Publication Data

US 2012/0263884 A1 Oct. 18, 2012

Related U.S. Application Data

(62) Division of application No. 12/063,299, filed as application No. PCT/JP2005/020076 on Nov. 1, 2005, now abandoned.

(30) Foreign Application Priority Data

Aug. 23, 2005 (WO) ..... PCT/JP2005/015238

(51) Int. Cl.
*B05D 3/06* (2006.01)
*B44C 1/175* (2006.01)

(52) U.S. Cl.
CPC ..... *B44C 1/175* (2013.01)
USPC ..... 427/510; 428/195.1

(58) Field of Classification Search
USPC ..... 427/510
See application file for complete search history.

(56) References Cited

U.S. PATENT DOCUMENTS

| | | | | |
|---|---|---|---|---|
| 7,951,255 | B2 * | 5/2011 | Ikeda et al. | 156/275.5 |
| 2002/0016226 | A1 | 2/2002 | Jin et al. | |

FOREIGN PATENT DOCUMENTS

| | | | |
|---|---|---|---|
| JP | 02-123172 | A | 10/1990 |
| JP | 04-197699 | A | 7/1992 |
| JP | 05-016598 | A | 1/1993 |
| JP | 2001-092118 | A | 4/2001 |
| JP | 2003-200698 | A | 7/2003 |
| JP | 2003-313489 | A | 11/2003 |
| JP | 2005-014604 | A | 1/2005 |
| JP | 2005-125776 | A | 5/2005 |
| JP | 2005-169693 | A | 6/2005 |
| JP | 2006007646 | A | 1/2006 |
| JP | 2008-238683 | A | 10/2008 |
| WO | 2010-126125 | A1 | 11/2010 |

* cited by examiner

*Primary Examiner* — Mark Ruthkosky
*Assistant Examiner* — Ian Rummel
(74) *Attorney, Agent, or Firm* — Pearne & Gordon LLP

(57) ABSTRACT

A coating agent (60) comprising an ultraviolet ray hardening resin composite (62) to be applied on a water pressure transfer film (20) contains no organic solvent, but contains at least photo-polymerization pre-polymer, photo-polymerization monomer and photo-polymerization initiator and having a viscosity of 10 to 100 CPS (25° C.) and an ink solubility of 10 or more at an SP value. This can positively and effectively perform the operation of recovering the adhesion of the dried print pattern of the water pressure transfer film and also imparting the ultraviolet ray hardenability to the print pattern.

2 Claims, 3 Drawing Sheets

COATING AGENT FOR A WATER PRESSURE TRANSFER FILM, A WATER PRESSURE TRANSFER METHOD AND A WATER PRESSURE TRANSFER ARTICLE

TECHNICAL FIELD

This invention relates to a coating agent for a water pressure transfer film, and more particularly to a coating agent for a water pressure transfer film used for reproducing (recovering) an adhesion of a dried print pattern of a water pressure transfer film to be transferred onto a surface of an article to be decorated and also to a water pressure transfer method using the coating agent for the water pressure transfer film and a water pressure transfer article produced thereby.

BACKGROUND OF TECHNOLOGY

There has been used a water pressure transfer method for decorating a complicated three-dimensional surface of an article. Typically, this water pressure transfer method is the one in which a transfer film having a predetermined water-insoluble print pattern applied onto a water-soluble film is floated on a water surface within a transfer tub and made wet with the water and an article (a transferred body or a body to be pattern-transferred) is immersed into the water within the transfer tub while it contacts the transfer film whereby the print pattern of the transfer film is transferred onto the surface of the article by using the water pressure to thereby form a decorative layer.

In general, since the water pressure transfer film is stored in a roll form with the print pattern printed and dried on the water soluble film, the print pattern is in a dry state while it have an adhesion lost and therefore it is required to coat a solvent such as an activator or a thinner to the print pattern so as to get a wet state similar to a state of the ink immediately after being printed (a state where it has an adhesion), which is generally called an activation treatment. In order to provide mechanical or chemical surface protection function such as wear resistance, solvent resistance, medicine resistance, weather resistance, etc. to the decorative layer formed on the surface of the article by the water pressure transfer, a transparent surface protection layer (topcoat layer) is generally formed on the top of the decorative layer.

Such a surface protection layer is formed either by being applied by spray means or by water pressure transfer means etc., separately from the decorative layer or by water pressure transfer method at the same time when the decorative layer is formed by water pressure transfer (see Patent Documents 1 and 2). In either of these cases, since the decorative layer itself has no surface protection function, the surface protection layer separate from the decorative layer is required. However, since the method of separately forming the surface protection layer and the decorative layer requires two operations of decoration and surface protection, the effectiveness in operation gets lower and since the method of simultaneously forming the surface protection layer and the decorative layer requires a water pressure transfer film of complicated construction. Thus, any of the methods cannot disadvantageously provide the decorative layer having the protected surface in an inexpensive manner.

Meantime, the inventors have proposed the invention of a method of transferring a decorative layer under water pressure while the wear resistance, the solvent resistance etc. are imparted to the decorative layer itself and this invention has been applied for patent (see Patent Documents 3 through 5). According to this method, an ultraviolet ray hardening resin composite containing a non-solvent type activation ingredient such as a photo-polymerization monomer is applied onto a dried print pattern of a water pressure transfer film whereby the adhesion of the print pattern is recovered by the activation ingredient of the ultraviolet ray hardening resin composite. Also, since the print pattern is transferred onto the objective body under water pressure in the state where the ultraviolet ray hardening resin composite permeates the whole print pattern, when the ultraviolet ray hardening resin composite is hardened by radiation of ultraviolet rays, the decorative layer formed by the print pattern just gets the state where the ultraviolet ray hardenability is imparted thereto and therefore the chemical and mechanical surface protection function such as the solvent resistance, the wear resistance etc. are imparted to the decorative layer itself.

In order to integrally combine the print pattern and the ultraviolet ray hardening resin composite by allowing the ultraviolet ray hardening resin composite to permeate the print pattern for recovering the adhesion of the dried print pattern and imparting the ultraviolet ray hardenability to the print pattern by applying the ultraviolet ray hardening resin composite to the water pressure transfer film, the ultraviolet ray hardening resin composite requires the viscosity relatively lower enough for the resin composite to be able to uniformly permeate the whole print pattern once dried and cured and the ink solubility being able to dissolve the ink and recover the adhesion thereof and this ultraviolet ray hardening resin composite is desirably applied to the print pattern in a predetermined amount of application. If the viscosity of the ultraviolet ray hardening resin composite is too high, then this ultraviolet ray hardening resin composite cannot permeate the whole print pattern in a proper amount, if the ink solubility of the ultraviolet ray hardening resin composite is too low, then the adhesion of the print pattern of the state where it is dried and cured cannot be recovered, and the amount of application of the ultraviolet ray hardening resin composite is too low, then the ultraviolet ray hardening resin composite cannot reach the surface of the print pattern (an outer face of the print pattern after transferred).

Further, if the viscosity of the ultraviolet ray hardening resin composite is too low and the amount of application thereof is too high, the print pattern is invited to be disturbed whereby there appears the phenomena where the pattern gets obscure or disordered.

Thus, the ultraviolet ray hardening resin composite requires a predetermined viscosity, ink solubility and amount of application in order to recover the adhesion of the dried print pattern and allow the ultraviolet ray hardening resin composite to permeate the print pattern so as to be integrally combined or mixed with the print pattern. What is meant by "integral combination of the ultraviolet ray hardening resin composite" is not for the ultraviolet ray hardening resin composite to be partially combined with the print pattern, but for the ultraviolet ray hardening resin composite to be wholly combined with the print pattern preferably in a uniformly combined manner. If the ultraviolet ray hardening resin composite is combined with the print pattern only on the side of application of the resin composite, but does not reach the outer surface of the print pattern after transferred, the surface protection function such as the solvent resistance, etc. cannot be imparted to the surface of the decorative layer, which is the outermost surface of the decorative layer.

In the invention of the aforementioned method proposed by the inventors, it is disclosed to use what is commercially available under "UV MAT-000 MEDIUM", the trade name of UV type screen ink from TEIKOKU INK MANUFACTURE CO., LTD., Japan or what is commercially available under the name "UV PAL-000 MEDIUM", the trade name of UV type screen ink from TEIKOKU INK MANUFACTURE CO., LTD., Japan as the ultraviolet ray hardening resin composite suitable for recovering the adhesion of the print pattern and for integrally combining the ultraviolet ray hardening resin composite with the print patter by permeation of the ultraviolet ray hardening resin composite into the whole print pattern. These composites are commercially available for wide use and can recover the adhesion of the dried print pattern and impart the ultraviolet ray hardenability to the print pattern by its permeation into the whole print pattern to a certain extent. Thus, these ultraviolet ray hardening resin composites for wide use can be applied just to a water pressure transfer of low or middle grade in which a pattern just like grain should just be attached. These ultraviolet ray hardening resin composites for wide use cannot be fully applied to a water pressure transfer of high or super-high grade in which a minute design quality such as true tree feeling required for decoration in a car interior article. In addition thereto, these ultraviolet ray hardening resin composites cannot be fully applied to various transfer films having huge accumulation of the past with respect to the elements of the ink such as the kind of ink or the shade to be used for the print pattern and there remain the problems in compatibility and conformity with various equipment used in the conventional water pressure transfer processing lines.

These commercially available ultraviolet ray hardening resin composites contain at least photo-polymerization pre-polymer, photo-polymerization monomer and optical initiator and are manufactured as products for various uses such as inks, coating materials, adhesives or the likes by preparing them and adding other ingredients in some cases. These commercially available ultraviolet ray hardening resin composites were not such products as were manufactured for intentional use in which the resin composites permeate the whole ink once dried and cured so as to be integrally combined with the print pattern and is hardened together with the ink after the ultraviolet ray is radiated as if the ultraviolet ray hardenability is imparted to the ink. In the embodiment disclosed in the aforementioned patent documents, what enables the recovery of the adhesion of the ink and the provision of the ultraviolet ray hardenability to the print pattern is found out of the conventional products of other uses and are used compromisingly.

The inventors make various preparations while photo-polymerization pre-polymer, photo-polymerization monomer etc. change in their kinds and combinations when they looked for a novel ultraviolet ray hardening resin composite most suitable as a coating agent for a water pressure transfer film having a viscosity relatively low enough to be able to uniformly permeate the whole print pattern once dried and cured and an ink solubility enough to recover the adhesion of the ink by dissolving it and with the result of repetitive tests, they find that there are required a predetermined viscosity and a predetermined ink solubility for the ultraviolet ray hardening resin composite suitable for the coating agent for the water pressure transfer film and that such settings as the selection of the photo-polymerization monomer are much important for it.

More particularly, the photo-polymerization monomer has the following requirements;

(1) The photo-polymerization monomer itself has low viscosity in order to obtain the proper viscosity of the ultraviolet ray hardening resin composite having the photo-polymerization monomer added thereto.

(2) The photo-polymerization monomer requires the solvent power to the photo-polymerization polymer essential for the physical property of the finished coating film tending to have a high viscosity.

(3) The photo-polymerization monomer requires the solvent power to the ink of the print pattern.

(4) The photo-polymerization monomer itself also has a good hardenability when the ultraviolet ray is irradiated.

(5) The photo-polymerization monomer has a good adhesion to ABS resin, PC materials etc. used as base materials of a water pressure transfer article in many cases.

(6) The photo-polymerization monomer requires a lower contractility when cured and a smoothness and also has a transparency maintained.

Thus, it is found that the coating agent for the water pressure transfer film comprises an ultraviolet ray hardening resin composite containing the photo-polymerization monomer meeting the aforementioned requirements.

[Patent Document 1] JP4-197699A

[Patent Document 2] JP2003-200698A

[Patent Document 3] JP Application No. 2003-409874 specification

[Patent Document 4] JP2005-14604A

[Patent Document 5] WO2004/108434

DISCLOSURE OF INVENTION

Problems to be Solved by Invention

A first object of the invention is to provide a coating agent for a water pressure transfer film suitable for recovering an adhesion of a print pattern of the water pressure transfer film and also for positively and effectively accomplishing an operation of imparting an ultraviolet ray hardenability to the print pattern.

Another object of the invention is to provide a method of transferring a print pattern on an article by using a coating agent for a water pressure transfer film suitable for recovering an adhesion of the print pattern of the water pressure transfer film and also for positively and effectively accomplishing an operation of imparting an ultraviolet ray hardenability to the print pattern.

Further object of the invention is to provide a water pressure transfer article manufactured by using a coating agent for a water pressure transfer film suitable for recovering an adhesion of a print pattern of the water pressure transfer film and also for positively and effectively accomplishing an operation of imparting an ultraviolet ray hardenability to the print pattern.

Disclosure of the Invention

According to a first feature of the invention, there is provided a coating agent for a water pressure transfer film comprising an ultraviolet ray hardening resin composite to be coated on the water pressure transfer film so as to recover an adhesion of a dried print pattern of the water pressure transfer film and permeating the whole print pattern and so as to be integrally combined with the print pattern after hardening by ultraviolet ray whereby an ultraviolet ray hardenability is imparted to the print pattern, the ultraviolet ray hardening resin composite containing no organic solvent, but containing at least photo-polymerization pre-polymer, photo-polymerization monomer and photo-polymerization initiator and having a viscosity of 10 to 100 CPS (25° C.) and an ink solubility of 10 or more at an SP value.

In the first feature of the invention, the photo-polymerization monomer desirably has the viscosity of 3 to 30 CPS (25° C.) and the ink solubility of 9 or more at the SP value.

In the first feature of the invention, the photo-polymerization monomer may be preferably 1.6 hexanediol-diacrylate and a content thereof may be desirably 50 to 90% by weight conversion relative to the total weight of the ultraviolet ray hardening resin composite.

In the first feature of the invention, the photo-polymerization initiator contains both of surface-hardening photo-polymerization initiator and interior-hardening photo-polymerization initiator and the interior-hardening photo-polymerization initiator may be preferably 10 to 90% by weight conversion relative to the total weight of the photo-polymerization initiator. In this case, the surface-hardening photo-polymerization initiator may be more preferably of hydroxy-ketone system while the interior-hardening photo-polymerization initiator may be more preferably of acylphosphine-oxide system.

In addition thereto, in the first feature of the invention, resin beads may be added to the ultraviolet ray hardening resin composite.

According to a second feature of the invention, there is provided a water pressure transfer method comprising the steps of coating an ultraviolet ray hardening resin composite on a dried print pattern on a water-soluble film of a water pressure transfer film when the print pattern is transferred under water pressure on a surface of an article so as to recover an adhesion of the print pattern of the water pressure transfer film by a non-solvent activation component of the ultraviolet ray hardening resin composite and also so as for the ultraviolet ray hardening resin composite to permeate the print pattern and be contained in the print pattern; transferring the print pattern on the article by forcing the article under water together with the water pressure transfer film while the ultraviolet ray hardening resin composite combined print pattern is forced against the surface of the article, and thereafter irradiating an ultraviolet ray onto the article whereby the ultraviolet ray hardening resin composite and the ultraviolet ray hardening resin composite combined print pattern are hardened while they are integrally combined, said method characterized by transferring the print pattern under water pressure by forcing the article to have the print pattern transferred while contacting the water pressure transfer film after applying onto the print pattern of the water pressure transfer film a coating agent according to the aforementioned first feature of the invention.

In the second feature of the invention, the coating agent for the water pressure transfer film may be preferably applied having the thickness of 3 to 30 μm.

According to a third feature of the invention, there is provided a water pressure transfer article characterized by being manufactured by the method according to the second feature of the invention.

Although the coating agent for the water pressure transfer film according to the invention comprises the ultraviolet ray hardening resin composite, the photo-polymerization monomer of the ultraviolet ray hardening resin composite has a solvent power to an ink of the print pattern as well as that to the photo-polymerization pre-polymer, a higher hardenability, a good adhesion to ABS resins, PC materials, etc., which are base materials onto which the print pattern is to be transferred under water pressure, a lower contractility when hardened and a good smoothness and also has a good transparency maintained. Thus, the dried and cured print pattern of the water pressure transfer film can be positively recovered by the proper viscosity and ink solubility of the ultraviolet ray hardening resin composite and since the ultraviolet ray hardening resin composite permeates and penetrates the whole thickness of the print pattern from the surface on the side of application of the coating agent to the surface on the opposite side so that the print pattern and the ultraviolet ray hardening resin composite are integrally combined with each other over the whole of the print pattern (all the areas and the thickness thereof), the decorative layer obtained by the print pattern transferred on the article is hardened by the ultraviolet ray allover the decorative layer including the outer surface and therefore the print pattern can be solidly attached on the surface of the article and in addition thereto the surface protection function according to the ultraviolet ray hardening can be imparted to the decorative layer itself. Thus, this invention can be fully applied to the water pressure transfer of high or super-high grade in which a minute design quality such as true tree feeling is required and can be fully applied to various transfer films having huge accumulation of the past with respect to the elements of the ink such as the kind of ink. Furthermore, the invention has the compatibility and conformity with various equipment used in the conventional water pressure transfer processing lines.

According to the invention, the solubility of the ultraviolet ray hardening resin composite can be closer to that of the ink component of the print pattern by using the ultraviolet ray hardening resin composite having the particular viscosity of 10 to 100 CPS (25° C.) and the particular ink solubility of 10 or more at the SP value. Furthermore, the smoother coating to the ink component of the print pattern and the permeability of the ultraviolet ray hardening resin composite to the ink component can be maintained.

Furthermore, according to the invention, since there is used the photo-polymerization monomer having the particular viscosity of 3 to 30 CPS (25° C.) and the particular ink solubility of 9 or more at the SP value, the photo-polymerization pre-polymer having a tendency of high viscosity can be fully dissolved so as to reduce its viscosity and also the solubility of the ultraviolet ray hardening resin composite can be closer to that of the ink component of the print pattern. Therefore, there can be obtained the ultraviolet ray hardening resin composite maintaining the property of smoothly applying the ultraviolet ray hardening resin composite on the ink component of the print pattern (smooth applicability) and the property in which the ultraviolet ray hardening resin composite can permeate the ink component in a good manner (permeability). In addition thereto, the ultraviolet ray hardening resin composite can fully maintain the good adhesion to the ABS resins, the PC materials etc. of the base materials, the smoothness and the transparency when hardened and therefore there can be obtained the coating agent for the water pressure transfer film.

In the invention, the term "containing no organic solvent" does not mean that there is absolutely zero of a "solvent ingredient" but is never exclusive of one having solvent ingredient added in order to escape from the invention or having solvent ingredient used for producing the monomer or the pre-polymer, but remained if there can be obtained the function of re-adhesion of the print pattern by the non-solvent activation ingredient in the ultraviolet ray hardening resin composite, which is typically photo-polymerization monomer to the necessary and full degree. Similarly, the term "containing no organic solvent" does not mean that there is absolutely zero of "volatility" of the photo-polymerization monomer etc., but means that it is not as high as the solvent and therefore it may have the volatility in such a degree as can be disregarded practically.

BEST MODE OF EMBODIMENT OF INVENTION

Figure 1:
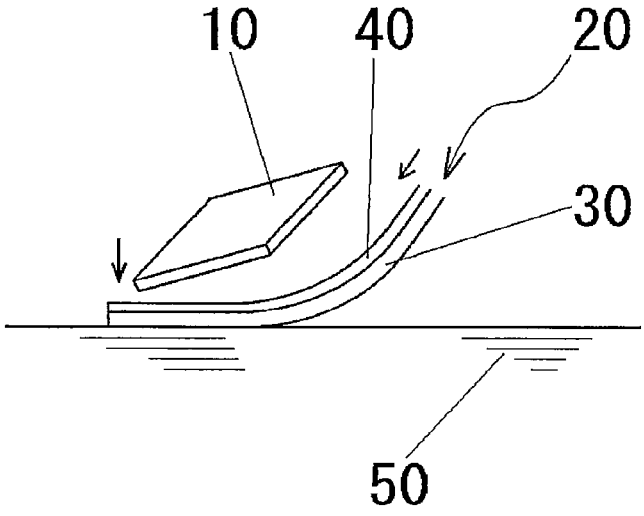
FIG. 1 is an outline view in which a water pressure transfer method to be performed by using a coating agent of the invention is briefly illustrated.

Describing some modes of embodiment of the invention with reference to the drawings, FIG. 1 briefly illustrates a water pressure transfer method to which the invention may be applied. This water pressure transfer method is the one in which a transfer film 20 comprising a water soluble film 30 having a print pattern 40 applied thereon is supplied and floated on water 50 within a transfer bath with the print pattern directed upside and an article 10 to have the print pattern transferred thereon under water pressure is forced underwater through the transfer film 20 whereby the water pressure transfer is accomplished.

The water soluble film 30 is formed of water soluble material having a main ingredient of polyvinyl alcohol, for example, which gets wet and is softened by absorbing water. This water soluble film 30 is softened when it contacts the water 50 within the transfer tub and is wound around the article 10 to be decorated whereby the water pressure transfer can be accomplished. The print pattern 40 may be previously applied on the water soluble film 30 by gravure printing and so on in case of general water pressure transfer and is in state of dryness and solidification in which the transfer film has the adhesion completely lost before the water pressure transfer should be performed. It should be noted that what is meant by the "print pattern" 40 includes plain one (one having no pattern) other than the one originally having a pattern.

Figure 2:
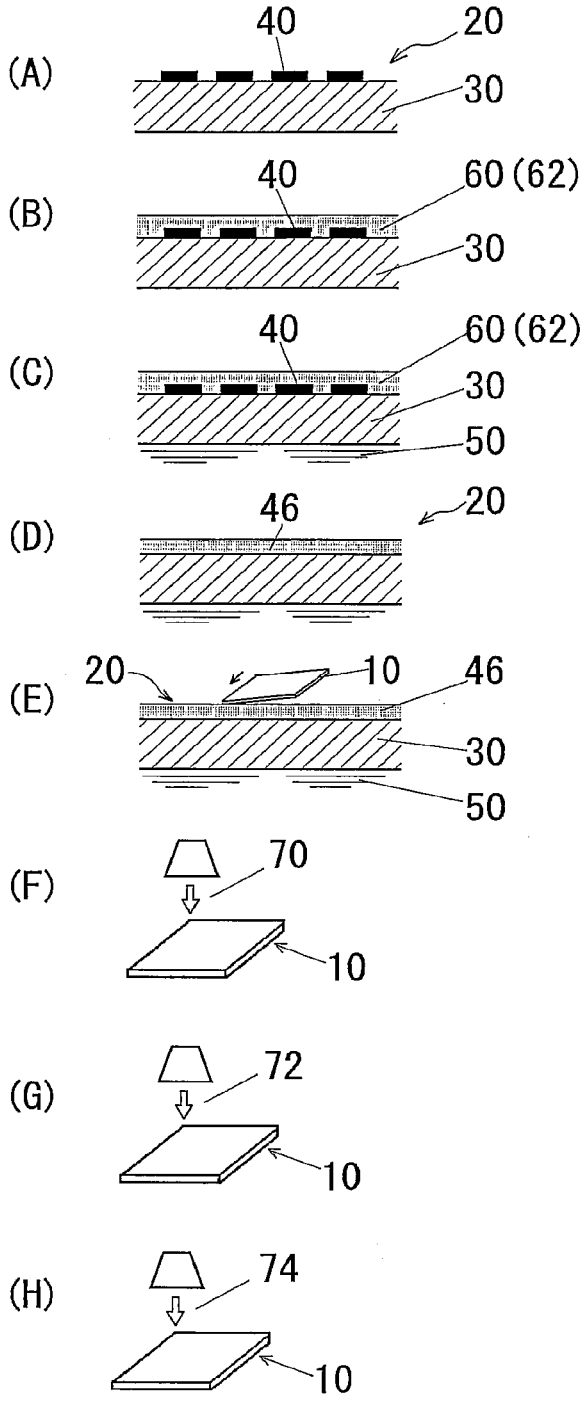
FIG. 2 illustrates each of the steps of the water pressure transfer method to be performed on an article by using the coating agent of the invention.

As shown in FIG. 2, the water pressure transfer method to which the invention is applied is the one in which an ultraviolet ray hardening resin composite 62 for a coating agent 60 is applied to the print pattern 40 of the transfer film 20 (see FIG. 2B) before the water pressure transfer is applied onto an article 10 (see FIG. 2A), the adhesion of the print pattern 40 is recovered by the non-solvent activation component of the ultraviolet ray hardening resin composite 62 and at the same time, the ultraviolet ray hardening resin composite 62 permeates and is absorbed by the whole print pattern 12 (all the areas and all the thicknesses thereof) so that the ultraviolet ray hardening resin composite 62 is mixed or combined with the print pattern 40 (see FIG. 2C). In this manner, the ink component of the print pattern 40 and the ultraviolet ray hardening resin composite 62 coated on and permeating the print pattern 40 are combined with each other whereby the ultraviolet ray hardening resin composite combined print pattern 46 is formed (see FIG. 2D).

After transferring onto the article under water pressure the transfer film 20 having the adhesion of the print pattern 40 recovered by the ultraviolet ray hardening resin composite 62 and also having the ultraviolet ray hardening resin composite combined print pattern 46 formed by combining the ultraviolet ray hardening resin composite 62 with the whole print pattern 40 in this manner (see FIG. 2E), the ultraviolet ray is irradiated onto the article 10 (see FIG. 2F) whereby the ultraviolet ray hardening resin composite of the ultraviolet ray hardening resin composite combined print pattern 46 is hardened while it is integrally combined with the print pattern, which corresponds to the phenomena that the print pattern 40 itself has the ultraviolet ray hardenability imparted thereto. Thus, the decorative layer 44 itself formed by transferring the ultraviolet ray hardening resin composite combined print pattern 46 is supposed to have the surface protection function because the ultraviolet ray hardening resin composite is distributed into the decorative layer and hardened by the ultraviolet ray (see FIG. 3).

The ultraviolet ray 70 of FIG. 2F is preferably irradiated while the water-soluble film 30 of the transfer film 20 is wound around the article 10 on which the ultraviolet ray hardening resin composite combined print pattern 46 is transferred and thus it is preferably carried out while the article 10 is still underwater or before the water-soluble film is water-washed and removed even though it comes out of the water. The ultraviolet ray 70 is irradiated by a conventional ultraviolet ray hardening equipment including light source lamps such as high-pressure mercury lamps or metal halide lamps and an irradiation machine (lamp house).

Figure 3:
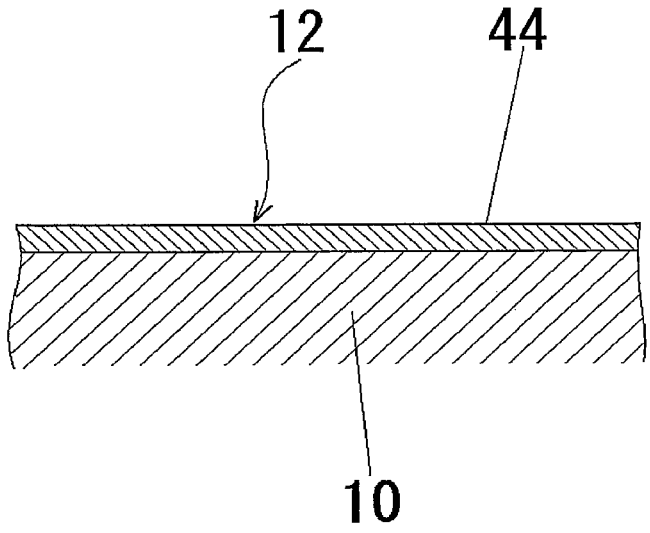
FIG. 3 is an enlarged cross sectional view of an article having a decorative layer obtained by the method of FIG. 2.

Then, as shown in FIG. 2G, the water shower 72 and so on washes the article 10 by water to thereby remove the water-soluble film (swellable and soluble film layer) which the top face of the article 10 is covered with and subsequently, a hot wind 74 dries the surface of the article 10 whereby the decorated product 12 having the decorative layer 44 transferred under water pressure is completed (see FIG. 3).

The ultraviolet ray hardening resin composite 62 used for the coating agent of the invention is a resin which can be hardened for a relatively shorter time by a chemical action of the ultraviolet ray. This resin composite may be in the form of ultraviolet ray hardening type coating material, ultraviolet ray hardening type ink or ultraviolet ray hardening type adhesives and fundamentally has an essential components of (1) photo-polymerization pre-polymer, (2) photo-polymerization monomer and (3) optical initiator or photo-polymerization initiator, which is similar to the conventional one, but the coating agent 60 of the invention is characterized by containing no organic solvent and having a predetermined viscosity and a predetermined ink solubility as described later in details.

The ultraviolet ray hardening resin composite of the invention may comprise an ingredient having the following composition.

| | |
|---|---|
| (1) Oligomer (photo-polymerization pre-polymer) | 9-40 mass % |
| (2) Single functional or multi-functional monomer | 50-90 mass % |
| (3) Optical initiator or photopolymerization initiator | 0.5-5 mass % |
| (4) Non-reactive additives (excluding resin beads) | 0.5-5 mass % |

The ultraviolet ray hardening resin composite 62 used for the invention is required to have the viscosity of 10 to 100 CPS (25° C.) and the ink solubility of 10 or more at the SP value ("CPS" and "SP value" will be explained later). If the viscosity is less than 10 CPS, then the content of the photo-polymerization monomer is too high, the satisfactory coating film property cannot be obtained and therefore even though the decorative layer has the ultraviolet ray hardening resin composite integrally combined and hardened by the ultraviolet ray, it has no good results in a wiping test where durability of the decorative layer is tested relative to solvents such as xylene. Reversely, if it exceeds 100 CPS, then the content of the photo-polymerization monomer is too low, the ultraviolet ray hardening resin composite cannot fully permeate the whole dried ink of the print pattern 40 and therefore the adhesion of the ink cannot be recovered in a good manner. If the ink solubility of the ultraviolet ray hardening resin composite is less than 10 at the SP value, then the print pattern 40, that is the decorative layer 44 is hard to be attached onto the article 10 after the water pressure transfer, even though the resin composite can permeate the dried ink of the print pattern 40 so as to recover the adhesion of the ink.

As the photo-polymerization monomer has the viscosity of 3 to 30 CPS (25° C.) and the ink solubility of 9 or more at the SP value, then the ultraviolet ray hardening resin composite having the viscosity of 10 to 100 CPS (25° C.) and the ink solubility of 10 or more at the SP value can be easily prepared.

If the solubility of the ultraviolet ray hardening resin composite itself is 10 or more at the SP value, then it gets closer to the solubility of the ink component of the print pattern 40 and therefore the resin composite can provide the sufficient ink solvent power thereto even though it contains no organic solvent.

The term "CPS" in the viscosity of the ultraviolet ray hardening resin composite used for the invention is an abbreviation of "centipoises". The numerical value used in the specification indicates the results obtained by measuring the viscosity using B-type viscometer (Form of BM) manufactured by Tokyo Keiki Co., Ltd.

The term "SP value" in the ink solubility of the ultraviolet ray hardening resin composite is an abbreviation of "Solubility Parameter" and is defined as the square root of cohesive energy density. This is a parameter proposed by Hildebrand and Scott based on the regular solution where the enthalpy variation occurs when the entropy variation due to mixture is almost zero. What is meant by the term "cohesive energy density" is the ratio of the energy required for evaporating a molecule and the molecular volume of the molecule. The solvents having chemical structures similar to each other have the SP values closer thereto and are easily soluble because of reduced solution heat. This corresponds to the experience rule that the similar things are soluble with each other. Thus, the SP value is used as the most familiar parameter with respect to "solution". In general, the SP value of the "solvent" is determined by evaporation heat and the SP value of "high polymer" is obtained by the determination of the viscosity or the expansion degree or by the reverse gas chromatography process. If the SP value is unknown, there are employed the Hildebrand rules, the method in which the relationship of surface tension introduced by experience rules is used or the Fedors method in which the cohesive energy constant of atom group is used under structural formula. The fundamental expression of the SP value (δ) is indicated by the following formula;

$$\delta=(\Delta E/V)^{1/2}$$

(In the above expression, ⊿E: molecular cohesive energy (cal/mol) V: molecular volume (ml/mol))

The SP value used in the invention is based on the turbidimetric titration method announced by K. W. Sue and D. H. Clarke, which is described in "Journal of Polymer Science Part A-1, Vol. 5, pages 1671-1681 (1967).

The photo-polymerization pre-polymer used for the ultraviolet ray hardening resin composite of the invention is a polymer to be further hardened by a photo-chemical action and is called as photo-polymerization unsaturated polymer, a base resin or a photo-polymerization oligomer. This is an ingredient to affect fundamental properties for a finished coating film after hardened and an effectiveness in operation and an acryl system oligomer, a polyester system oligomer, an epoxy acrylate system oligomer and an urethane acrylate system oligomer may be used independently or they may be used as combined arbitrarily according to the desired characteristic. The photo-polymerization pre-polymer has a polymerization degree not so high as a final polymer, but not a monomer. Since this has some polymerization degree and some viscosity, this is required to be diluted to the viscosity sufficient for the coating agent for the water pressure transfer film.

The photo-polymerization monomer serves to dilute the photo-polymerization and also to dissolve the dried and cured print pattern (ink) to impart the adhesion thereto and performs the polymerization of itself when an ultraviolet ray is irradiated thereon.

There is a single functional monomer having a single functional group and a multi-functional monomer having two or more functional group for the photo-polymerization monomer. The single functional monomer has a function of improving the adhesion to the article and imparting a softness to the coat film after hardened while the multi-functional monomer has a function of a crosslinking agent, which crosslinks the molecules of the pre-polymers as well. Since the multi-functional monomer of more than three function has too high viscosity, it is not desirable for the coating agent for the ultraviolet ray hardening resin of the invention.

To this end, for the photo-polymerization monomer able to be used for the ultraviolet ray hardening resin composite of the invention may be the single functional monomer such as cyclohexyl-acrylate, 2-hydroxy-propylacrylate, isobornyl acrylate, phenoxy-ethyl-acrylate, tetrahydro-furfural-acrylate and benzyl-methacrylate or the two functional monomer such as 1.6-hexyanediol-diacrylate, dipropyleneglycol-diacrylate, ethyleneglycol-dimethacrylate, neopenthylglycol-diacrylate, 1.9-nonanediohl-diacrylate, diethyleneglycol-dimethacrylate, neopenthylglycol-dimethancrylate and tri-propylene-glycol-diacrylate.

However, the photo-polymerization monomer usable for the ultraviolet ray hardening resin composite of the invention is required to have the solvent power to the ink of the print pattern in addition to the solvent power to the photo-polymerization pre-polymer, the hardenability and the low contractibility when hardened and is also required to have a good adhesion to ABS resin or PC materials as a base material of the article to be decorated and a smoothness and also has a transparency maintained. Some concrete examples of the photo-polymerization monomer to be able to be used with these properties will be shown in Table 1.

TABLE 1

| Monomer | 1.6 hexane-diol diacrylate | Di-propyrene glycol diacrylate | Isobonyl acrylate | Tri-propylene glycol diacrylate |
|---|---|---|---|---|
| Functional group | 2 | 2 | 1 | 2 |
| Viscosity CPS/25° C. | 5-10 | 5-15 | 4-10 | 8-20 |
| Solubility parameter SP Value | 9.43 | 9.15 | 7.44 | 8.65 |
| Adhesion | | | | |
| ABS | ○ | ○ | ▲ | x |
| PC | ○ | ○ | x | x |
| Hardenability | ○ | ○ | ○ | ○ |
| Solvent power | | | | |
| To oligomer | ○ | ○ | ○ | ▲ |
| To ink | ○ | ▲ | — | — |

As shown in the above table, if the base materials of the articles to be decorated are the ABS resin or the PC resin, the photo-polymerization monomer is desirably 1.6 hexane-diol-diacrylate, cyclohexyl-acrylate or dipropyleneglycol-diacrylate in consideration of the adhesion to the articles, 1.6 hexanediol-diacrylate or dipropyleneglycol-diacrylate in consideration of the ink solubility parameter (SP value) and 1.6 hexanediol-diacrylate, dipropyleneglycol-diacrylate or isobornyl acrylate in consideration of the permeability and solvent power to the ink. Thus, as all these physical properties are simultaneously taken into consideration, it will be noted that 1.6 hexanediol-diacrylate or dipropyleneglycol-diacrylate are desirable and more particularly, 1.6 hexanediol-diacrylate is most desirable. The content of the 1.6 hexanediol-diacrylate is desirably 50 to 290% in weight conversion relative to the total ultraviolet ray hardening resin composite.

The optical initiator serves to start the polymerization reaction by absorbing the ultraviolet ray and is also called a photo-polymerization initiator and since the ultraviolet ray hardening resin composite dissolves and permeates the dried and solidified ink, the resin composite preferably includes both of a surface-hardening type optical initiator and an interior-hardening type optical initiator. The interior-hardening type optical initiator may be suitably used when the print pattern contains black ink. As the resin composite includes both of the optical initiators, the content of the surface-hardening type optical initiator is desirably 10 to 90% relative to the total optical initiator in weight conversion. A hydroxyl-ketone system, for example, may be used for the surface-hardening type optical initiator and an acyl-phosphine oxide system, for example, may be used for the interior-hardening type optical initiator.

The ultraviolet ray hardening resin composite may have a leveling agent, an anti-foaming agent, an ultraviolet ray absorption agent, a stabilizer (a degradation prevention agent), etc., added thereto, if necessary. Furthermore, the ultraviolet ray hardening resin composite may have resin beads added thereto so that such a design as expresses something like a haze can be performed for the whole decorative layer. If glass beads are used instead of the resin beads, they precipitate due to their big specific gravity and therefore such resin beads as PET resin beads, acrylate resin beads or urethane resin beads may be desirably used. The diameter of the grain may be desirably about 10 μm and the content of the beads may be desirably about 30 weight %.

Although the step of applying the ultraviolet ray hardening resin composite 62 may be carried out by means of either of photogravure roll, wire bar coating and spray, since the spray applying process tends to consume a lot of coating materials, the photogravure roll application process or the wire bar application process may be preferably employed.

The amount of application of the ultraviolet ray hardening resin composite is not specifically limited, but the ultraviolet ray hardening resin composite may be applied in quantity enough to fully recover the adhesion of the print pattern 40 and also to fully permeate the print pattern 40 so as to reach the opposite surface thereof and be combined with the print pattern 40 by radiation of the ultraviolet ray in the predetermined quantity after transfer. As described in the Patent Document 3, if the ultraviolet ray hardening resin composite is applied onto the print pattern 40, it permeates and is combined with the ink composite, it is difficult to independently define the layer thickness, but in order to permeate the print pattern 40 of 3 μm and be united therewith, for example, the thickness of the ultraviolet ray hardening resin composite may be appropriately about 10 μm and it may be 10-15 μm in a wet condition of the activated print pattern layer (the print pattern layer 46 with which the ultraviolet ray hardening resin composite is mixed).

EMBODIMENTS

Some concrete embodiments will be explained hereinafter.

Embodiment 1

The coating agent according to this embodiment is composed of the ultraviolet ray hardening resin composite having the following composition;

| | |
|---|---|
| (1) Urethane-acrylate (oligomer) | 30.8% |
| (2) 1.6 hexanediol-acrylate (two-functional acrylate monomer) | 61.6% |
| (3) Hydroxyketone system (surface-hardening type) optical initiator | 2.4% |
| (4) Acylphosphine-oxide system (interior-hardening type) optical initiator | 2.4% |
| (5) Polyether-modified polysiloxane (leveling agent) | 0.5% |
| (6) Acrylic resin composite (anti-foaming agent) | 0.5% |
| (7) Hydroxyphenyltriazine (HPT) system UV ray absorber | 0.9% |
| (8) Hinderd amine (HALS) system light stabilizer | 0.9% |
| TOTAL | 100.0% |

The decorative layer of predetermined pattern was formed onto the article having an ABS resin composite used as a base material by the water pressure transfer method shown in FIG. 2 using the coating agent composed of the ultraviolet ray hardening resin composite according to the EMBODIMENT 1. In this case, the print pattern of the transfer film has the thickness of 3 μm and the coating agent of the invention was applied until it reached the thickness of 10 μm by the wire bar coating process. As the adhesion of the thus formed decorative layer of the article was tested by a cross cut tape adhesion test method (1 mm cross 100 measures), it is confirmed that the adhesion of the article was equivalent to those of the conventional water pressure transfer article having the print pattern transferred by activating the print pattern by using the conventional organic solvent type activator and having no topcoat layer applied and the conventional top-coated water pressure transfer article having a conventional urethane resin top coat layer applied thereto.

In order to perform the test of solvent resistance of the thus formed decorative layer, as a ten-sheet piled gauze containing xylene was reciprocatively wiped on the surface of the product eight times while it was rubbed thereon as a solvent resistance test, it is confirmed that the product had little damage of the decorative layer, which was not so good as the water pressure transfer article having the conventional topcoat layer and showed solvent resistance as good as the conventional top-coated water pressure transfer product. This shows that the decorative layer was formed while the ultraviolet ray hardening resin composite permeated and entered into the print pattern until it reached the surface of the print pattern (the surface opposite to the application surface) and was mixed with the print pattern so as to be integrally united with each other.

In particular, as the water pressure transfer was performed by applying the coating agent on the transfer film having the transfer pattern of Indian ink, that is of black ink much used, the thus transferred product had the adhesion much higher than that of the water pressure transfer product formed by applying the "UV MAT-000 MEDIUM" and "UV PAL-000 MEDIUM" manufactured by and commercially available from TEIKOKU INK MANUFACTURE CO., LTD., Japan, which was the ultraviolet ray hardening resin composite disclosed by the applicant. In addition thereto, even though the water pressure transfer was performed by applying the coating agent onto the transfer film having the transfer patterns in which the kind of inks and the shade thereof were used in the form oppositely different from each other or the transfer film having the minute design drawn, which was among the transfer films having huge accumulation of the past with respect to these elements, the better water pressure transfer could be performed without producing such defects as what is called pinholes or ink lumps, etc., or without extending the pattern or reversely fading the pattern. Furthermore, various equipment used in the processing line of the conventional water pressure transfer could be used without changing any condition setup while the conventional state was almost maintained.

Embodiment 2

The coating agent according to this EMBODIMENT is composed of the ultraviolet ray hardening resin composite having the following composition. Similarly, the ratio of content is weight %.

| | |
|---|---|
| (1) Urethane-acrylate (oligomer) | 30.7% |
| (2) Neopentylgrycol-diacrylate (two-functional acrylate monomer) | 61.4% |
| (3) Hydroxyketone system (surface-hardening type) optical initiator | 7.4% |
| (4) Polyether-modified polysiloxane (leveling agent) | 0.5% |
| TOTAL | 100.0% |

The decorative layer of predetermined pattern was formed onto the article having an ABS resin composite used as a base material by the water pressure transfer method shown in FIG. 2 using the coating agent composed of the ultraviolet ray hardening resin composite according to the EMBODIMENT 2 in the same manner as in the EMBODIMENT 1. In the same manner as the EMBODIMENT 1, the print pattern of the transfer film has the thickness of 3 μm and the coating agent of the invention was applied until it reached the thickness of 10 μm by the wire bar coating process. As the adhesion of the thus formed decorative layer of the article was tested by the cross cut tape adhesion test method (1 mm cross 100 measures), it is confirmed that the adhesion of the article was equivalent to those of the conventional water pressure transfer article having the print pattern transferred by activating the print pattern by using the conventional organic solvent type activator and having no topcoat layer applied and the conventional top-coated water pressure transfer article having a conventional urethane resin top coat layer applied thereto.

Similarly, in order to perform the test of solvent resistance of the decorative layer obtained by the EMBODIMENT 2, as the ten-sheet piled gauze containing xylene was reciprocatively wiped on the surface of the product eight times while it was rubbed thereon as a solvent resistance test, it is confirmed that the product had little damage of the decorative layer, which was not so good as the water pressure transfer article having the conventional topcoat layer and showed solvent resistance as good as the conventional top-coated water pressure transfer product. This shows that the decorative layer was formed while the ultraviolet ray hardening resin composite permeated and entered into the print pattern until it reached the surface of the print pattern (the surface opposite to the application surface) and was mixed with the print pattern so as to be integrally united with each other.

Even though the color of ink of the transfer film to which the coating agent according to this EMBODIMENT was applied was of Indian ink type and had the high concentration so difficult as for the ultraviolet ray to pass through the ink, the product had the adhesion much higher than that of the water pressure transfer product formed by applying the "UV MAT-000 MEDIUM" and "UV PAL-000 MEDIUM" manufactured by and commercially available from TEIKOKU INK MANUFACTURE CO., LTD., Japan, which was the ultraviolet ray hardening resin composite disclosed by the applicant. However, in comparison with the EMBODIMENT 1, in the case where the water pressure transfer method was performed by applying the coating agent according to the EMBODIMENT 2 onto the transfer film having the transfer pattern formed by various kinds of ink, the shade of which remarkably changed, it is found that such defects as pinholes and ink grains were sometimes produced and that some performance was reduced. It will be considered that this is caused by the little lower ink solubility of the used photo-polymerization monomer component and also by the little lower ink solubility of the ultraviolet ray hardening resin composite as the coating agent.

[Possibility of Utilization in Industries]

According to the invention, the adhesion of the ink of the print pattern can be positively recovered in a higher effectiveness of operation by applying the ultraviolet ray hardening resin composite on the dried print pattern on the transfer film to be transferred on an article and at the same time the ultraviolet ray hardening resin composite can effectively permeate the print pattern so as to be mixed with the print pattern. Thus, there can be provided the coating agent for accomplishing the adhesion of the print pattern to be transferred under water pressure and also the surface protection function of the decorative layer simultaneously and therefore the availability in industries can be remarkably improved.

What is claimed is:

1. A water pressure transfer method for applying a print pattern onto an article surface including recovering the adhesion of the print pattern dried on a water soluble film of a water pressure transfer film, comprising the steps of:

(a) applying a coating agent for a water pressure transfer film comprising an ultraviolet ray hardening resin composite to be coated on said water pressure transfer film so as to recover an adhesion of a dried print pattern of said water pressure transfer film and so as to permeate the whole print pattern and be integrally combined with said print pattern whereby an ultraviolet ray hardenability is imparted to said print pattern, said ultraviolet ray hardening resin composite containing no organic solvent, but containing at least photo-polymerization pre-polymer, photo-polymerization monomer and photo-polymerization initiator wherein said photo-polymerization pre-polymer is 9 through 40 mass percent of the composite, said photo-polymerization monomer is 50 through 90 mass percent of the composite, said photo-polymerization initiator is of 0.5 through 5 mass percent of the composite, and said ultraviolet ray hardening resin composite has a viscosity of 10 to 100 CPS (25° C.) and a Hildebrand solubility parameter of 10 or more and said photo-polymerization monomer has the viscosity of 3 to 30 CPS (25° C.) and a Hildebrand solubility parameter of 9 or more onto the dried print pattern to recover the adhesion of the print pattern, to permeate the whole print pattern so as to be integrally combined with the print pattern, and to thereby impart an ultraviolet ray hardenability to the print pattern, b) forcibly immersing the article together with the transfer film into water so as to force the surface of the article onto the transfer film whereby the print pattern is transferred under water pressure onto the surface of the article, and c) irradiating an ultraviolet ray on the article to harden the hardening resin compound which is integrally combined with the print pattern whereby an ultraviolet ray hardenability is imparted to the print pattern.

2. A water pressure transfer method as set forth in claim 1, wherein step (a) includes applying the coating agent at a thickness of 3 to 30 μm.

* * * * *